US007861904B1

(12) United States Patent
Taylor et al.

(10) Patent No.: US 7,861,904 B1
(45) Date of Patent: Jan. 4, 2011

(54) ROLLED TAPE DISPENSER

(75) Inventors: Curtis P. Taylor, Moreland Hills, OH (US); Stephen E. Mika, Shaker Heights, OH (US)

(73) Assignee: Process4, Chagrin Falls, OH (US)

( * ) Notice: Subject to any disclaimer, the term of this patent is extended or adjusted under 35 U.S.C. 154(b) by 1431 days.

(21) Appl. No.: 10/963,343

(22) Filed: Oct. 12, 2004

(51) Int. Cl.
*B26F 3/02* (2006.01)

(52) U.S. Cl. ..... 225/65; 225/66

(58) Field of Classification Search ..... 225/46, 225/47, 65, 66, 61, 77, 78, 56, 58, 39, 19; 242/588.6, 422.5
See application file for complete search history.

(56) References Cited

U.S. PATENT DOCUMENTS

| | | | | | |
|---|---|---|---|---|---|
| 329,191 | A | * | 10/1885 | McMurtrie | 206/53 |
| 391,305 | A | | 10/1888 | Ehrlich | 225/76 |
| 450,036 | A | | 4/1891 | Rein | 225/76 |
| 450,943 | A | | 4/1891 | Krieckhaus | 225/76 |
| 613,138 | A | | 10/1898 | Gempeler | 242/396.6 |
| 673,778 | A | | 5/1901 | Merritt | 242/396.6 |
| 962,684 | A | | 6/1910 | Wallace | 225/76 |
| 1,069,108 | A | | 8/1913 | Buhl | 242/588.1 |
| 1,177,636 | A | | 4/1916 | Kuehn | 242/588 |
| 1,228,501 | A | | 6/1917 | Twite | 242/388 |
| 1,374,556 | A | | 4/1921 | Dunn | 242/396.6 |
| 1,554,082 | A | | 9/1925 | Gerould | 242/129.6 |
| 1,605,030 | A | | 11/1926 | Hurley | 225/76 |
| 1,818,514 | A | | 8/1931 | Whitaker | 242/588.1 |
| 1,973,354 | A | | 9/1934 | Nedberg | 242/55.5 |
| 1,977,187 | A | | 10/1934 | Katz | 242/55.5 |
| 1,990,135 | A | | 2/1935 | Sato | 242/97 |
| 1,991,263 | A | | 2/1935 | Stewart | 242/84.8 |
| 2,045,966 | A | | 6/1936 | Ruehmann | 242/86 |
| 2,049,086 | A | | 7/1936 | Shingleton | 200/59 |
| 2,525,992 | A | | 10/1950 | Wynn | 242/96 |
| 2,542,580 | A | | 2/1951 | Sato | 242/97 |
| 2,683,000 | A | | 7/1954 | Beiderwell | 242/100 |
| 2,704,190 | A | | 3/1955 | Schmale et al. | 242/86 |
| 2,717,129 | A | | 9/1955 | McDonald | 242/99 |
| 2,731,084 | A | * | 1/1956 | Burns | 225/65 |
| 2,815,180 | A | | 12/1957 | Pratt | 242/86.1 |
| 3,086,723 | A | | 4/1963 | Meeks | 242/55.2 |
| 3,176,892 | A | | 4/1965 | Waltz | 225/66 |
| 3,217,955 | A | | 11/1965 | Tinkey | 225/47 |
| 3,407,980 | A | | 10/1968 | Addison | 225/76 |
| 3,589,634 | A | | 6/1971 | Mason | 242/55.3 |
| 3,980,245 | A | | 9/1976 | Delehoy | 242/55.2 |

(Continued)

*Primary Examiner*—Stephen Choi
(74) *Attorney, Agent, or Firm*—Fay Sharpe LLP; Brian E. Turung

(57) ABSTRACT

A rolled tape dispenser that has a generally L-shaped body with a relatively short leg that supports a cutter blade and cover to extend transversely across the width of the cylindrical outer surface of a roll of tape, and a longer leg configured to extend along one of two opposite sides of the roll of tape. A spindle is configured to be inserted into a hollow central core of the roll of tape has an end region slidably connected to the longer leg for movement along the length of the longer leg. A resilient member connected to the body biases the spindle toward the cutter blade so that a roll of tape carried on the spindle has its generally cylindrical outer surface biased into engagement with the cutter blade, or, more preferably, into engagement with a thin portion of the shorter leg that underlies the cutter blade.

21 Claims, 12 Drawing Sheets

U.S. PATENT DOCUMENTS

| | | | | |
|---|---|---|---|---|
| 4,088,276 | A | 5/1978 | Littleton | 242/55.53 |
| 4,114,826 | A | 9/1978 | Diebolder | 242/85 |
| 4,225,071 | A | 9/1980 | Laviano | 225/65 |
| 4,667,890 | A * | 5/1987 | Gietman, Jr. | 242/532.2 |
| 4,832,271 | A | 5/1989 | Geleziunas | 242/55.53 |
| 5,238,201 | A | 8/1993 | Jonushaitis | 242/96 |
| 5,425,486 | A | 6/1995 | Kurker | 225/46 |
| 5,595,626 | A | 1/1997 | Yokouchi et al. | 156/577 |
| 5,641,109 | A | 6/1997 | Willoughby | 225/20 |
| 5,961,066 | A | 10/1999 | Hambleton | 242/588.1 |
| 6,012,674 | A | 1/2000 | Leeuwenburgh | 242/588.6 |
| 6,095,455 | A | 8/2000 | Green | 242/588.1 |
| 6,216,978 | B1 | 4/2001 | Rodriguez | 242/588.1 |
| 6,726,145 | B1 | 4/2004 | Kraus | 242/597.7 |
| 7,210,650 | B2 * | 5/2007 | Metzger | 242/588.6 |

* cited by examiner

ROLLED TAPE DISPENSER

BACKGROUND OF THE INVENTION

The present invention relates to a dispenser for a wide variety of types of tape sold in rolls, including several kinds of tape that are relatively difficult to hold and/or to dispense, for example, relatively thick woven fabric tape formed from synthetic material in fiber form such as polyamide, polyester and polyolefin polymers and the like such as Nylon, Dacron and Kevlar that carries no adhesive backing and therefor has a low coefficient of friction that renders the tape so slippery that the tape tends to unroll and slide out of the orderly coiled configuration in which a roll of tape is sold unless restrained against unrolling and uncoiling—a dispenser having portions that engage three surfaces of a coiled roll of tape to maintain the orderly configuration of the tape roll during dispensing—a dispenser that permits tape to be unrolled and dispensed as needed for continuous application or that permits desired lengths of tape to be severed from the roll as needed, and that permits a length of tape uncoiled from but not yet severed from the roll to be recoiled back onto the roll to be dispensed again, as tape is needed—a rolled tape dispenser that can be strap or belt supported alongside the thigh or hip of a worker for one-handed ease of use, or that can be held in one hand as the other hand is utilized to unroll and sever tape from a roll that has its orderly integrity maintained during dispensing.

Previously proposed rolled tape dispensers that were intended to be belt or strap supported so that a wearer could dispense either a continuous length of tape or a series of relatively short lengths of tape typically presented disadvantages resulting from complexity of design, high cost of component parts, inability to accommodate one-handed dispensing when strap or belt supported alongside the thigh or hip of a wearer, and operational characteristics that may change detrimentally as the diameter of a tape roll being dispensed diminishes. A prevalent and widely encountered drawback has been the failure of previously proposed dispensers to retain thick, slick surfaced, woven fabric tape in an orderly rolled form, often resulting in lengthy reaches of tape being trampled upon, being caught on ladders, scaffolding and the like, or wasted. Yet another commonly encountered drawback has been the lack of ease with which undamaged lengths of dispensed tape can be returned to the roll when more tape has been pulled from the roll than is needed at the moment.

SUMMARY OF THE INVENTION

These and other drawbacks are addressed by the present invention which, in some embodiments, provides a rolled tape dispenser characterized by an L-shaped body having a shorter leg that carries a cutter blade positioned to extend transversely across the cylindrical outer surface of a roll of tape, a longer leg that extends along one side of the roll of tape, a generally cylindrical spindle that is configured to be inserted into a hollow central core of a roll of tape to be dispensed and that parallels the transversely extending cutter blade as the spindle extends through the core of the tape roll, and a resilient member that biases the spindle toward the cutter blade so as to press the cylindrical outer surface of the tape roll either into engagement with the cutter blade, or, more preferably, into engagement with a thin portion of the shorter leg that underlies the cutter blade—by which arrangement, the coiled tape material on the roll is clamped between the spindle and the cutter blade or a portion of the shorter leg that underlies the cutter blade to retain the coiled tape material in an orderly rolled form until the roll is either rotated in one direction to dispense a length of tape from beneath the cutter blade, or the roll is rotated in an opposite direction to recoil an undamaged, unsevered length of dispensed tape back onto the roll.

In some embodiments of the present invention, the action of the resilient member in biasing a roll of spindle-supported tape toward the cutter blade brings a generally cylindrical outer surface of the roll of tape directly into engagement with the cutter blade so the orderly form of the roll of tape is maintained, at least in part, because the coiled tape material is clamped between the spindle and the cutter blade. In more preferred embodiments, however, the action of the resilient member in biasing a roll of spindle-supported tape toward the cutter blade brings the generally cylindrical outer surface of the roll of tape into engagement with a thin portion of the shorter leg of the body of the dispenser—a thin portion of material that underlies the cutter blade and holds a sharpened edge of the cutter blade a minute distance above the cylindrical outer surface of the roll of tape so that when the roll of tape is rotated in one direction to dispense tape, the tape being dispensed does not forcefully drag on the cutter blade itself, and so that when the roll of tape is rotated in an opposite direction to recoil an undamaged length of dispensed tape back onto the roll, the sharpened edge of the cutter blade permits the length of tape being recoiled to move smoothly beneath the cutter blade as it is returned to the roll.

In some embodiments of the present invention, the spindle has a circumferentially grooved end region, a first outwardly opening groove of which receives parallel extending portions of the longer leg that border opposite sides of a relatively wide slot that extends along a majority of the length of the longer leg—an arrangement that is utilized to mount the spindle on the longer leg for movement along the length of the longer leg so that rolls or spools of tape can have their generally cylindrical outer surfaces biased into engagement with the cutter blade (or into engagement with a thin portion of the shorter leg of the body, as described just above) to maintain the neatly coiled integrity of rolled tape during dispensing (as described just above). In some embodiments, the circumferentially grooved end region also provides a second outwardly opening groove around which a portion of the resilient member extends—an arrangement that permits the resilient member to bias the spindle toward the cutter blade. And, in some embodiments, the grooved end region also includes an enlarged head formation that defines the second and/or first outwardly opening grooves at a location along the spindle spaced from a portion of the spindle that is designed to be inserted into the hollow central core of rolls of tape that are to be supported on the spindle so tape thereon can be dispensed therefrom by the dispenser of the present invention.

In some embodiments, a rolled tape holder and cutter is comprised of relatively few, relatively simply configured, relatively easily assembled parts. The L-shaped body with its pair of relatively short and relatively long legs preferably is formed from injection molded plastics material as a one-piece structure which provides a smooth side of the longer leg that extends along one of the two opposed sides of a roll of tape.

In some embodiments, a cover that is removably connected to the L-shaped body of the dispenser—a cover that overlies a portion of the shorter leg and the cutter blade supported by the shorter leg—also is formed from injection molded plastics material as a one-piece structure, and defines a projection that extends at least a short distance along and engages one side of a spindle-carried tape roll in much the same manner that the longer leg extends along and engages a much longer portion of the other side of the spindle-carried tape roll—an arrangement that also assists in maintaining the orderly form of rolls of tape that are supported on the spindle of the dispenser. In place of, or in addition to the provision of a cover-defined projection that extends at least a short distance along a side of a spindle-supported tape roll (so that the roll is engaged near its periphery on one side by the cover-defined projection and on the opposite side by the longer leg of the body), the shorter leg of the body may be provided with such a projection that cooperates with the cover-defined projection to reinforce its strength, or that replaces the cover-defined projection entirely.

In some embodiments, the cover defines projections that extend along at least short lengths of both of the opposite sides of peripheral portions of a spindle-supported roll of tape, with one of these projections also extending along a short reach of the longer leg so that the two spaced projections of the cover engage the opposite sides of a spindle-supported tape roll near the periphery of the roll where tape can most easily uncoil from the roll unless dutifully restrained.

In some embodiments, the cover is provided with molded-in-situ markings that alert the user to the need to use caution in the vicinity of the sharpened edge of the cutter blade.

In some embodiments, the cutter blade takes the form of a commercially purchased blade of the type commonly used in box cutters—a blade that rests atop a portion of the shorter leg of the body, and that is held in place by the aforementioned cover—a cover that is connected to the shorter leg by threaded fasteners that can be removed with ease to facilitate blade replacement.

In some embodiments, the generally cylindrical spindle also is formed from injection molded plastics as a one-piece component that provides a relatively uniform diameter core-support portion that extends along most of the spindle's length, with the relatively uniform diameter being interrupted by a pair of opposed, relatively flat surfaces that permit the core support portion of the spindle to be inserted through the slot that extends along a majority of the length of the longer leg of the body to a position where the enlarged head of the spindle can be turned to snap its circumferentially extending groove into sliding engagement with formations that extend along opposite sides of the slot to establish a sliding connection between the spindle and the body.

In some embodiments, the resilient member that biases the spindle toward the cutter blade takes the form of a resilient, commercially purchased, endless band of material of the type often used to wrap about a bundle of documents—a band that preferably is protectively shielded from contact by portions of the longer leg of the body—a band that is received in a circumferentially extending groove defined by the enlarged head of the spindle.

In some embodiments, the resilient member that biases the spindle toward the cutter blade takes the form of a coiled tension spring—a spring that has opposite end regions connected to the body, with a central portion of the spring being wrapped around a portion of the spindle—a spring that is stretched by movement of the spindle away from the cutter blade, and that shortens as the spindle moves toward the cutter blade—a spring that preferably is received in a circumferentially extending groove formation of the spindle.

In some embodiments, the relatively long leg of the L-shaped body of the dispenser has a configuration that shields from view and from unwanted contact the resilient member that is interposed between the long leg and the spindle that slides along the long leg and that is biased by the resilient member toward the cutter blade of the dispenser.

In some embodiments, a removable guard is provided for shielding the cutter blade from inadvertent contact when the holder and dispenser is not being used to dispense cut lengths of tape—a guard that takes the form of a headed, finger-graspable pin that is inserted through holes formed through the shorter leg of the body and/or through the cover so the guard pin, when inserted, blocks contact with the sharpened edge of the cutter blade; and so that, when the guard pin is pulled out of holes that retain the pin in place via a frictional grip, tape can be severed from the roll after being dispensed in any of a wide variety of selected lengths.

In some embodiments, a support element that provides a means for connecting a support strap or belt to the body and/or to the cover of the rolled tape holder and dispenser, may take any of a variety of common forms, one example being a flexible band to which any of a wide variety of strap- or belt-carried connectors can be attached.

These and other features of the invention will be better understood from the detailed description that follows, taken together with the accompanying drawings.

DETAILED DESCRIPTION

Figure 1:
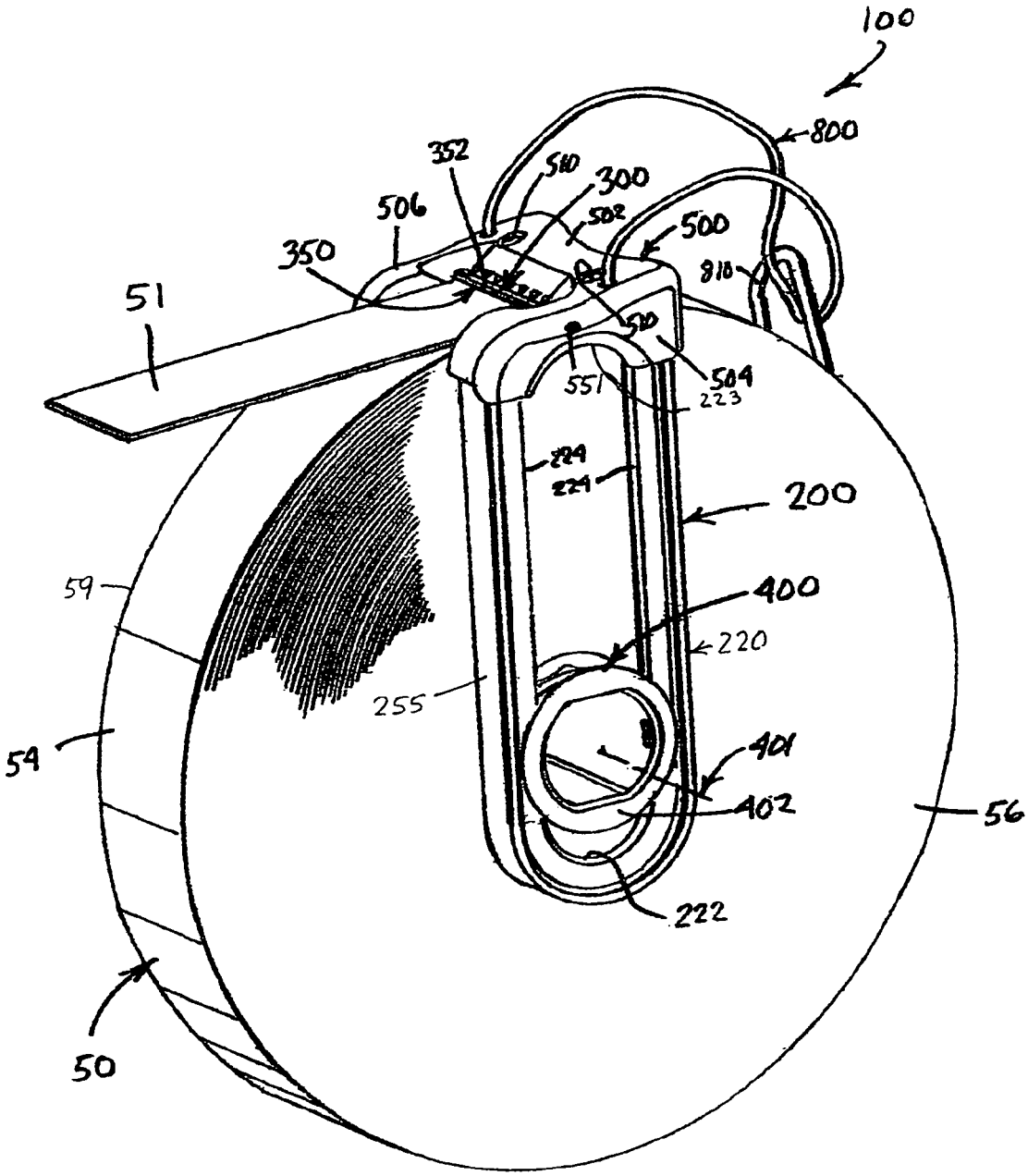
FIG. 1 is a perspective view of the inner side of a rolled tape dispenser that embodies features of the present invention, with a roll of tape supported on a spindle of the holder, with a cylindrical surface of the tape roll biased into engagement with a cutter blade of the dispenser, and with a short length of tape uncoiled from the roll and extending forwardly with respect to a removable guard pin that protectively shields a sharpened edge of the cutter blade from inadvertent user contact.
Figure 2:
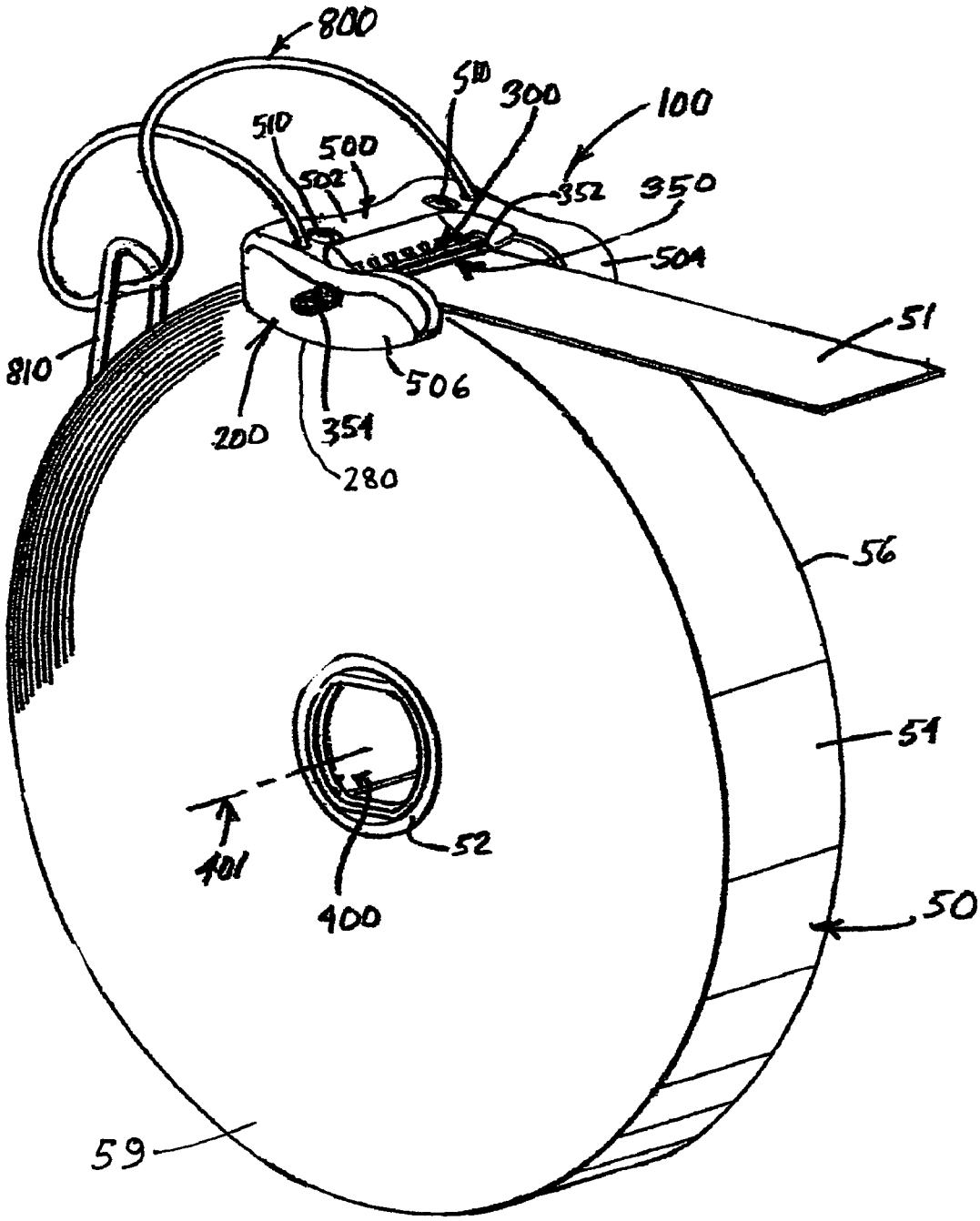
FIG. 2 is a perspective view of the outer side thereof.
Figure 3:
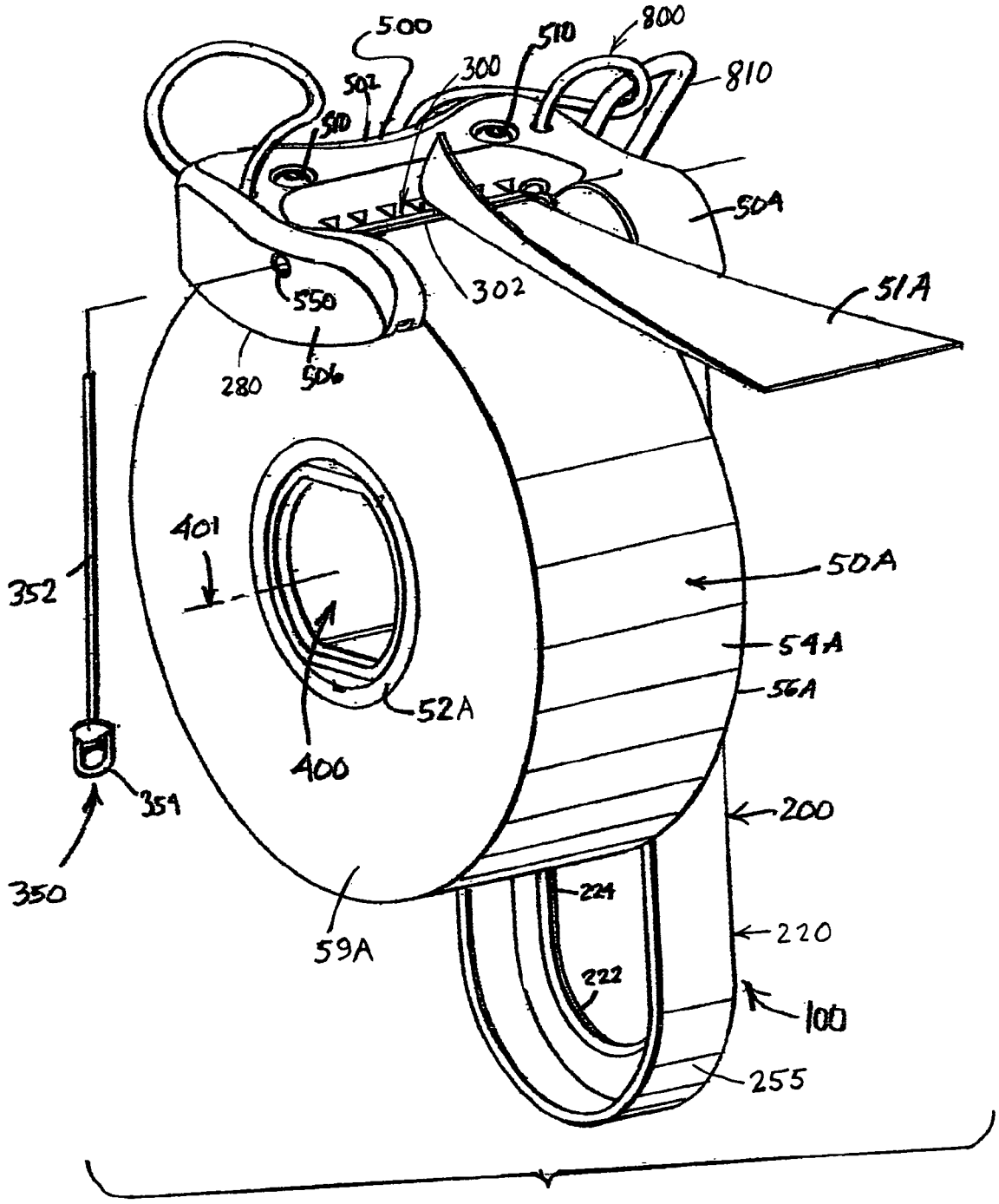
FIG. 3 is a perspective view similar to FIG. 2 but with the guard pin removed, with the tape roll partially depleted and with a short length of uncoiled tape in the process of being severed from the roll.

Referring to FIGS. 1-3, a rolled tape dispenser embodying features of the present invention is indicated generally by the numeral 100. The dispenser 100 has a body 200 that movably supports a spindle 400 which is shown in FIG. 2 extending into a hollow central core 52 of the relatively full-sized tape roll 50, and which is shown in FIG. 3 extending into a hollow central core 52A of a less-full, somewhat depleted tape roll 50A—by which arrangements, one or the other of the tape rolls 50, 50A may be mounted on the dispenser 100.

In FIGS. 1 and 2 the depicted full-sized tape roll 50 has a larger diameter than the somewhat depleted form of the tape roll 50A that is shown in FIG. 3. What FIGS. 1 and 2 show is how a short length of tape 51 can be pulled from the roll 50. What FIG. 3 shows is how a short length of tape 51A can be severed from the roll 50A by pulling a portion of the tape length 51A across the sharpened edge 302 of the cutter blade 300 of the dispenser 100 at a time after a guard pin 350 has been removed (as depicted in FIG. 3) from the installed position of the guard pin 350 as depicted in FIGS. 1 and 2.

When the full-sized tape roll 50 shown in FIGS. 1 and 2 is installed on the dispenser 100 (i.e., when the spindle 400 is inserted into the hollow, centrally located core 52 shown in FIG. 2 to mount the full-sized roll of tape 50 on the spindle 400), a resilient member 600 (see FIGS. 5-8) connected to the body 200 and to the spindle 400 biases a generally cylindrical outer surface 54 of the tape roll 50 toward the sharpened edge surface 302 of the cutter blade 300 of the dispenser 100, as will be explained shortly. Likewise, when the partially depleted tape roll 50A shown in FIG. 3 is installed on the dispenser 100 (i.e., when the spindle 400 is inserted into the hollow, centrally located core 52A shown in FIG. 3 to mount the tape roll 50A on the spindle 400), the resilient member 600 biases a generally cylindrical outer surface 54A of the tape roll 50A toward the sharpened edge surface 302 of the cutter blade 300.

For proper operation of the dispenser 100, the sharpened edge surface 302 of the cutter blade 300 must be properly positioned to ensure that, as the tape rolls 50, 50A diminish in diameter as tape is dispensed therefrom, the cutter blade 300 remains properly oriented with respect to the tape rolls 50, 50A so that tape can be severed easily from the rolls 50, 50A by drawing tape portions across the cutter blade edge 302 as is depicted in FIG. 3. To ensure that tape rolls of ever diminishing diameter are properly oriented with respect to the cutter blade 300 so tape can be readily severed from the rolls in the manner illustrated in FIG. 3, the sharpened edge surface 302 of the cutter blade 300 is mounted on a thin portion 215 (see FIG. 9) of the shorter leg 210 of the body 200 in alignment with a path of travel (indicated by the numeral 700 in FIG. 14) that is followed by a central axis 401 of the spindle 400 as the spindle 400 moves ever closer to the cutter blade 300 as roll diameter diminishes due to depletion of tape from the rolls 50, 50A which are biased by the aforementioned resilient member 600 toward the sharpened edge surface 302 of the cutter blade.

Figure 14:
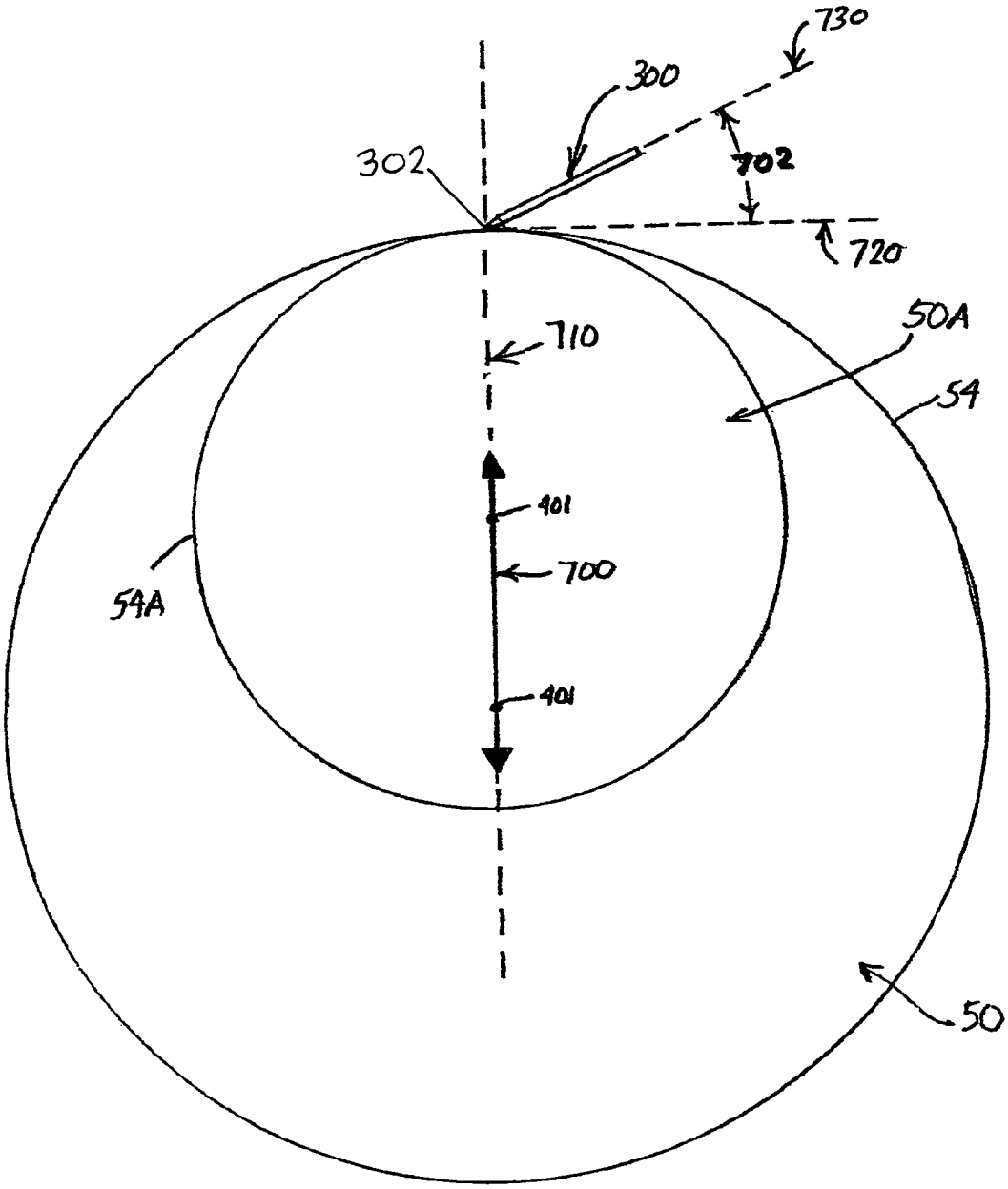

To explain this feature in greater detail, reference is made to FIG. 14 wherein the generally cylindrical outer surfaces 54, 54A of the tape rolls 50, 50A are shown, as are central axes 401 of the spindles 400 on which the tape rolls 50, 50A are supported. As can be seen in FIG. 14, the path of travel 700 of the axes 401 (as the axes 401 move ever closer to the cutter blade 300 during roll depletion) resides within a first imaginary plane 710 that is aligned with, and in fact, intersects with, the sharpened edge surface 302 of the cutter blade. Also, as can be seen in FIG. 14, the very minute portions of the cylindrical outer surfaces 54, 54A of the rolls 50, 50A that actually could engage the sharpened edge surface 302 reside within a second imaginary plane 720—a second imaginary plane that extends perpendicular to the first imaginary plane 710 and to the path of travel 700 that resides within the first plane 710. Furthermore, as can be seen in FIG. 14, the flat, thin steel cutter blade 300 extends substantially within a third imaginary plane 730—a third plane that is inclined at a fixed angle of orientation 702 that is determined by the orientation of a flat upwardly-facing surface of a relatively thin portion of the short leg 210 that is indicated by the numeral 215 in FIGS. 7 and 9 of the short leg 210.

In preferred practice, the thin portion 215 of the short leg 210 that underlies and supports the cutter blade 300 positions the cutter blade 300 so that the sharpened cutting edge 302 of the blade is held ever so slightly above the generally cylindrical outer surface 54, 54A of tape rolls 50, 50A that are biased toward the cutter blade 300 by the action of the resilient member 600 on the spindle 400. Although the extent to which the sharpened edge 302 is held in spaced relationship with the generally cylindrical outer surface 54, 54A of a tape roll 50, 50A is so minute as to be inapparent in the drawings, those who are skilled in the art will readily understand that even quite a small elevation of the sharpened cutting edge 302 is adequate to facilitate the movement of tape therebeneath, both when a spindle-supported tape roll 50, 50A is being rotated in one direction to dispense tape from the roll 50, 50A, and when the spindle-supported tape roll 50, 50A is being rotated in an opposite direction to re-coil dispensed lengths of undamaged, unsevered tape back onto the roll.

Configuring the thin portion 215 of the short leg 210 to permit tape to glide beneath the cutter blade 300 facilitates turning spindle supported tape rolls 50, 50A to dispense lengths of tape 51, 51A therefrom, and facilitates reverse turning of the tape rolls 50, 50A when it is desired to recoil lengths of dispensed tape 51, 51A, and is preferable to configuring the thin portion 215 in a manner that permits the generally cylindrical outer surfaces 54, 54A of spindle-supported tape rolls 50, 50A to be biased directly into engagement with the sharpened edge 302 of the cutter blade 300. One-handed dispensing is facilitated by this arrangement inasmuch as spindle-supported tape rolls 50, 50A that are biased into engagement with the underside of the thin portion 215 of the short leg 210 can be turned quite easily by applying the thumb of one hand to the outer surface 54, 54A of a spindle-supported tape roll 50, 50A to apply a gentle torque to the roll 50, 50A as needed to cause the outer surface 54, 54A to move along the underside of the thin portion 215.

Referring once again to FIG. 14, it is the alignment of the sharpened edge surface 302 of the cutter blade 300 with the path of travel 700 (i.e., the positioning of the cutter blade edge 302 so as to be intersected by the first imaginary plane 710) that causes the angle of inclination 702 of the blade 300 to remain constant regardless of the diameter of the generally cylindrical outer surfaces 54, 54A of the tape rolls 50, 50A during depletion of the supplies of tape therefrom. If the cutter blade edge 302 were positioned either to the right or to the left of the path of travel 700 (i.e., to the right or to the left of the first imaginary plane 710), the cutter blade 300 would engage the generally cylindrical outer surfaces 54, 54A of the rolls 50, 50A at angles of inclination that differ from the depicted angle 702 as the diameters of the tape rolls 50, 50A diminish in size.

For proper functioning of the dispenser 100, the angle of inclination 702 as depicted in FIG. 14 has been found by testing to perform most acceptably when it is within the range of about forty to about fifty degrees, with approximately forty-five degrees being optimal for use with a non-adhesive rolled tape of a variety of thicknesses and formed from a variety of fiber materials. Lengths of tape 51, 51A sever easily from the rolls 50, 50A when drawn across the cutter blade 300, as depicted in FIG. 3, especially when the cutter blade 300 has an angle of inclination 702 (as depicted in FIG. 14) within the range of about forty to about fifty degrees, with an angle of inclination 702 of approximately forty-five degrees being preferred.

Figure 7:
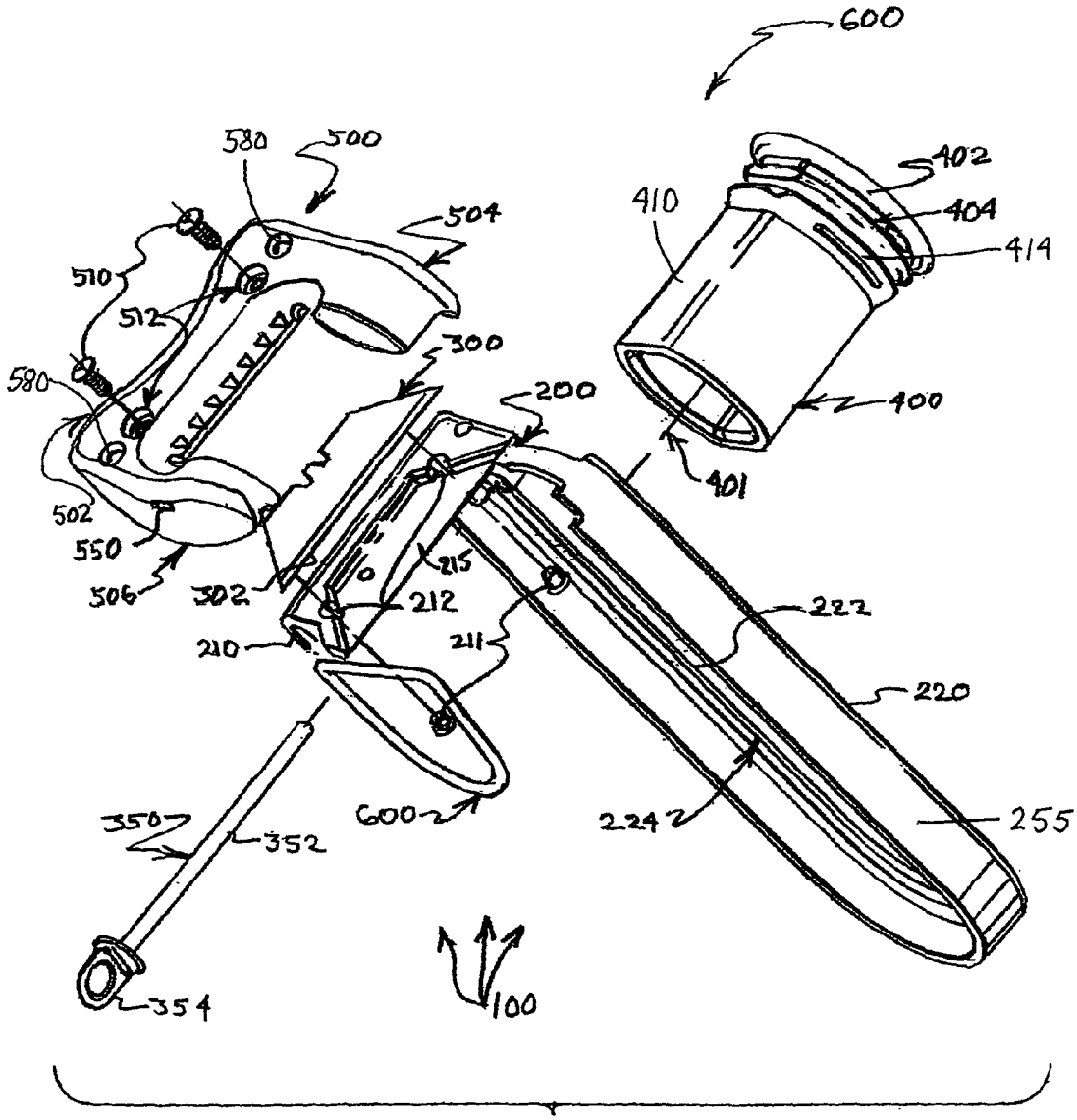
FIGS. 7-9 are exploded perspective views that show selected components of the dispenser.
Figure 8:
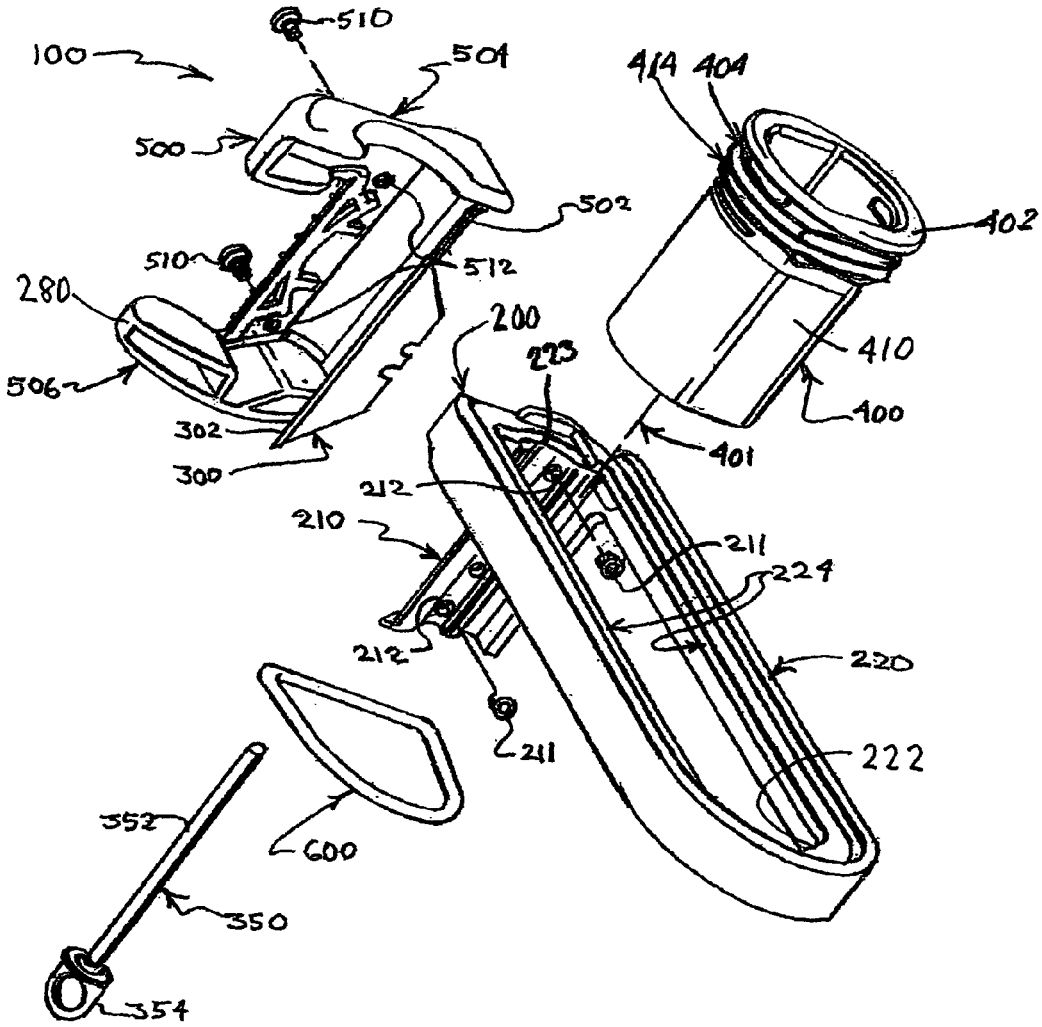

Returning to a description of major components of the dispenser 100, and referring now to FIGS. 7 and 8, the body 200 of the rolled tape dispenser 100 has a generally L-shaped configuration with a relatively short leg 210 joined at one end region thereof to one end region of a relatively long leg 220, and with the legs 210, 220 extending substantially perpendicular to each other. The shorter leg 210 is configured to extend transversely across the generally cylindrical outer surfaces 54, 54A of the tape rolls 50, 50A (when these rolls are supported on the spindle 400) to support the cutter blade 300. When the tape roll 50 is supported on the spindle 400, the longer leg 220 extends along an inner side 56 of the tape roll 50 as is depicted in FIG. 1. When the tape roll 50A is mounted on the spindle 400, the longer leg 220 extends along an inner side 56A of the tape roll 50A as is depicted in FIG. 3.

Referring still to FIGS. 7 and 8, the longer leg 220 has a relatively wide slot 222 formed therethrough that extends along a majority of the length of the longer leg 220. An upper end region of the slot 222 is indicated by the numeral 223 in FIG. 8. When no roll of tape is carried on the spindle 400, the biasing member 600 (which biases the spindle 400 toward the cutter blade 300) causes a portion of the spindle 400 to engage the upper end region 223 of the slot 222.

Figure 13:
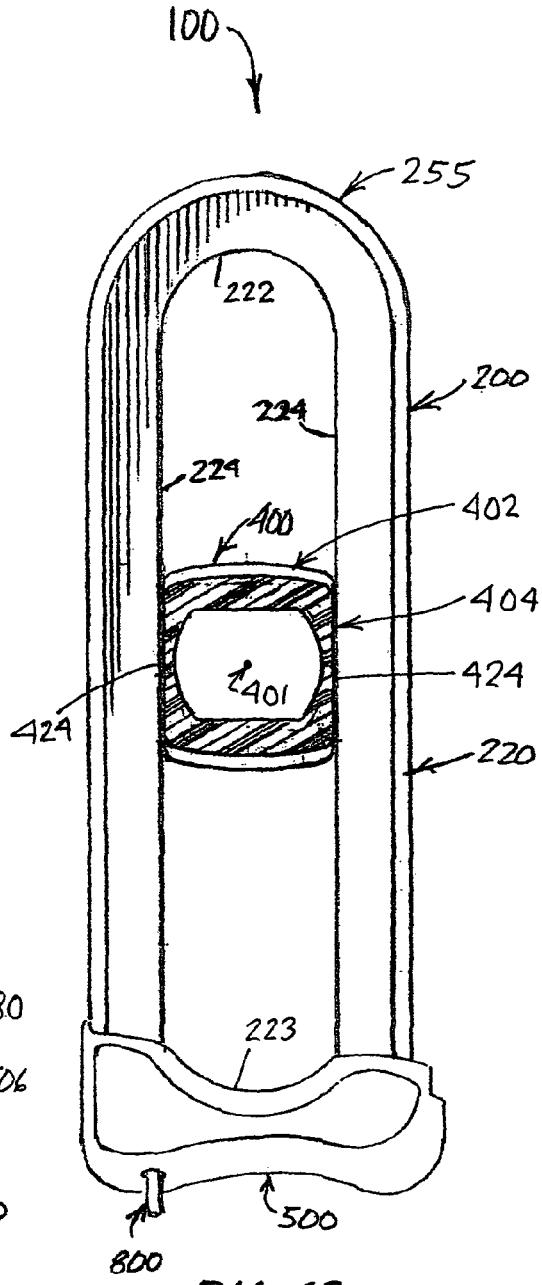
FIG. 13 is a inner side view thereof with a portion of the long leg of the body broken away and shown in cross-section as seen from a plane indicated by a line 13-13 in FIG. 12; and, FIG. 14 is a schematic view illustrating how rolls of tape biased toward the cutter blade of the tape dispenser have generally cylindrical outer surfaces that engage or very closely underlie a sharpened edge of the cutter blade at a fixed angle of inclination (i.e., an angle of inclination that does not change) regardless of the extent to which the diameter of a roll of tape has diminished due to depletion of the roll due to dispensing of tape therefrom, with this being true because the sharpened edge is located along and in alignment with a path of travel followed by rolls of tape that move relative to the dispenser as tape is dispensed therefrom.

Extending along opposite sides of the lengthy slot 222 are parallel-extending portions 224 of the long leg 220. When the spindle 400 is properly installed in the slot 222, the parallel-extending portions 224 are received in opposite sides of a first outwardly opening groove 404 that is defined by an enlarged head portion 402 of the spindle 400. Referring to FIG. 13, defined in bottom regions of the first outwardly opening groove 404 are a pair of opposed flat, outwardly facing surfaces 424 that are spaced apart by a distance that is slightly less than the spacing of the parallel-extending portions 224 so that, when the flat surfaces 424 face toward the parallel-extending portions 224 as shown in FIG. 13, the small space that remains between each of the surfaces 424 and its adjacent portion 224 permits the spindle 400 to slide smoothly along the length of the slot 222 without permitting the spindle to turn in the slot 222 about the spindle axis 401.

Also defined by the enlarged head formation 402 of the spindle 400 is a second outwardly facing groove 414, which is best seen in FIGS. 7, 8, 10 and 12. Although portions of the groove 414 may not extend around the full perimeter of the spindle 400, sufficient lengths of the groove 414 are provided to enable the resilient band-like biasing member 600 to be received therein at a location wherein the biasing member 600 is shielded from view and from inadvertent user contact by the parallel-extending portions 224 and/or by an outer wall 255 of the long leg 220. This arrangement establishes a smooth slip fit between the spindle 400 and the body 200 that permits the spindle 400 to move smoothly along the longer leg 220 (i.e., along the path of travel 700 which extends along the length of the slot 222 and along the length of the longer leg 220 of the body 200).

Referring to FIGS. 4-8, 10 and 12, the spindle 400 also has a region of reduced size 410 that is configured to be inserted into the interior of the generally cylindrical hollow central core 52 (see FIGS. 1, 2) or the core 52A (see FIG. 3) of the tape rolls 50, 50A. The reduced size region 410 of the spindle 400 extends from an outer end region of the spindle 400 to where the enlarged head formation 402 is provided at the inner end region of the spindle 400.

Referring to FIGS. 7 and 8, another component of the dispenser 100 is a cover 500 which, in preferred practice, takes something of a U-shaped configuration as defined by a transversely extending portion 502 that bridges between an inner end region 504 and an outer end region 506. The transversely extending portion 502 of the cover 500 is configured to overlie the cutter blade 300, and is removably connected to the shorter leg 210 of the body 200 by a pair of threaded fasteners 510 (best seen in FIG. 7) that extend through holes 512 formed through the cover 500, through holes 212 formed through the shorter leg 210, and are threaded into a pair of threaded inserts 211 that are installed in the holes 212 formed through the shorter leg 210. When the threaded fasteners 512 are tightened in place, they clamp the cover 500 toward the shorter leg 210 with the cutter blade 300 sandwiched therebetween—by which arrangement the cutter blade 300 is securely but removably connected to the shorter leg 210.

To assist in maintaining the properly coiled order of the tape rolls 50, 50A while these rolls are being dispensed, a projection 280 extends from an end region of the cover 500 to overlie a side surface 59 of the roll of tape 50 (or a side surface 59A of the roll of tape 50A). If desired, the projection 280 that overlies the side surface 59 or 59A can be provided as an integral formation of the short leg 210; or, the projection 280 may be formed as a combination of formations of the cover 500 and of the short leg 210.

Figure 5:
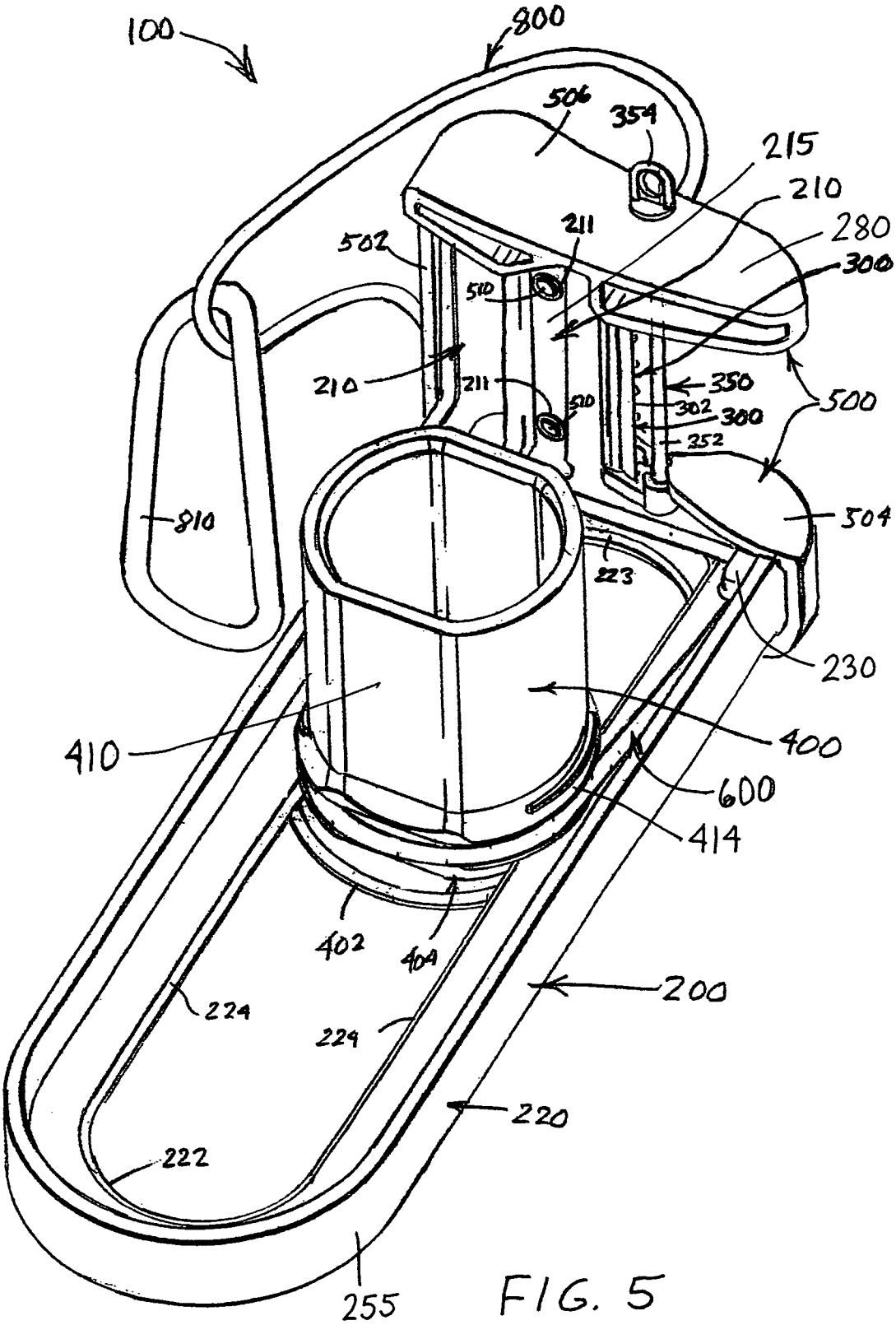
FIG. 5 is an additional perspective view, but with the spindle shown midway along the length of a longer leg of the body of the dispenser.
Figure 6:
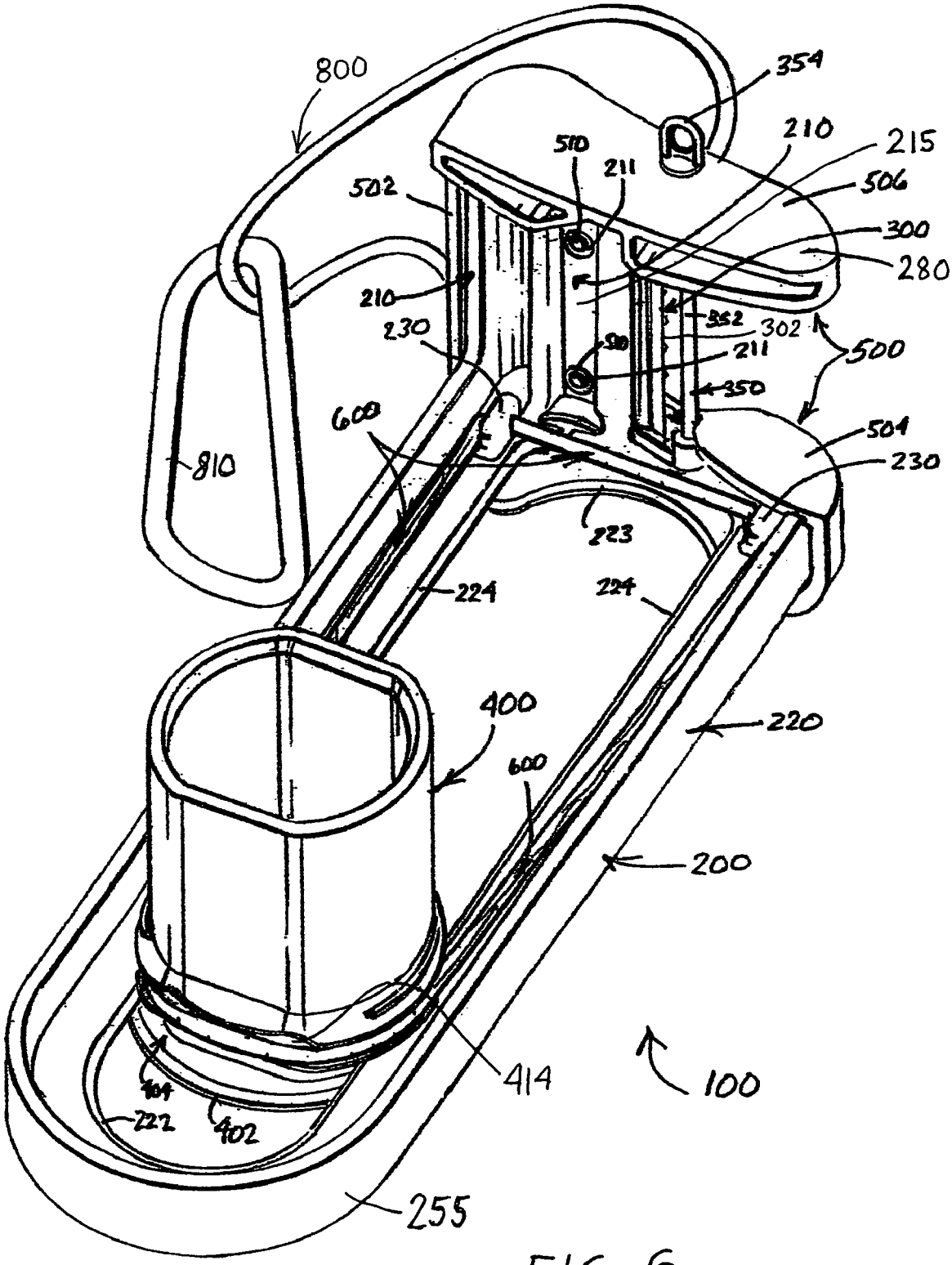
FIG. 6 is a perspective view similar to FIG. 5 but with the spindle shown slided to an extended position along the length of the longer leg of the body of the dispenser.

Referring to FIGS. 5-8, the resilient member 600 preferably takes the form of an endless resilient band that can be stretched in length, but which retracts after being stretched to a normal length due to the "memory" of the resilient material from which the resilient band 600 is formed. As is best seen in FIG. 6, a pair of body-defined retaining formations 230 are provided on opposite sides of the slot 222 near where the longer leg 220 joins the shorter leg 210 (i.e., near an upper end region 223 of the slot 222) to receive portions of the resilient member 600 near where an upper portion 603 of the resilient member 600 bridges across the upper end region 223 of the slot 222. As is also seen in FIG. 6, a lower portion 605 of the resilient member 600 wraps approximately half way around an outer surface portion of the enlarged head formation 402 of the spindle 400 (this portion of the resilient band 600 is received in the second outwardly facing groove 414 of the spindle 400, as described previously) by which arrangement the resilient member 600 serves to bias the spindle 400 generally toward the cutter blade 300.

Figure 4:
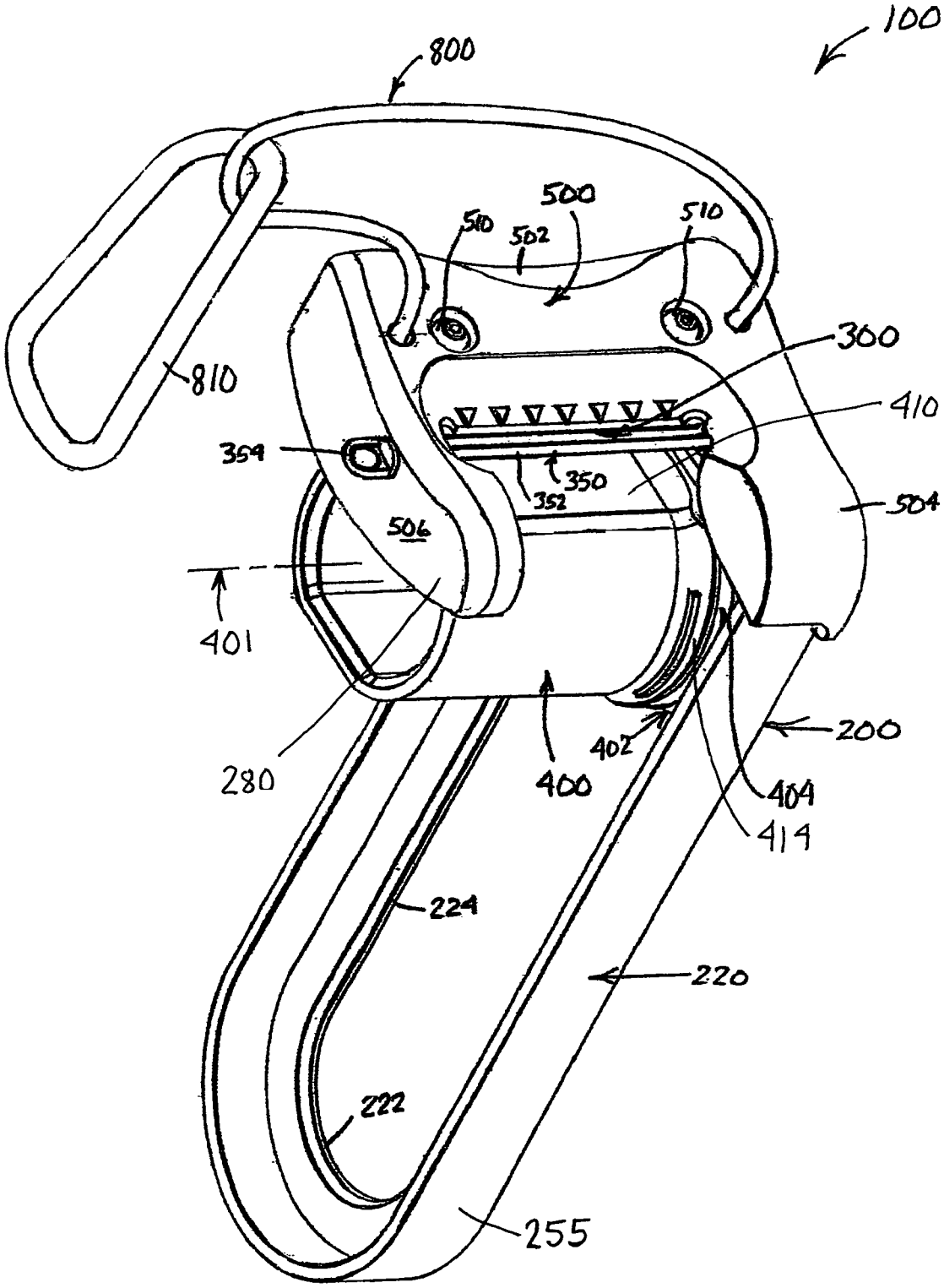
FIG. 4 is a perspective view of the tape dispenser with no tape roll supported on the spindle thereof, with the guard pin installed and with the spindle biased to a retracted position.

In FIGS. 1, 2 and 6, the spindle 400 is shown in what can be referred to as "extended positions" along the length of the slot 222—positions that normally are occupied by the spindle 400 only when the spindle 400 extends into the hollow interior core 52 of a full tape roll 50, such as is depicted in FIGS. 1 and 2. In FIGS. 3 and 5, the spindle 400 is shown in what can be referred to as "midway positions" along the length of the slot 222—positions that normally are occupied by the spindle 400 only when the spindle 400 is carrying a partially depleted roll of tape 50, such as the roll of tape 50 depicted in FIG. 3. In FIG. 4, the spindle 400 is shown in what can be referred to as a "retracted position" along the length of the slot 222—a position that normally is occupied by the spindle 400 only when no roll of tape 50 is supported by the spindle 400—a position near the upper end region 223 of the slot 222.

Referring to FIGS. 3, 7 and 8, the guard pin 350 has an elongate body portion 352 of substantially uniform, relatively small diameter that extends away from an enlarged finger-graspable head formation 354 located at one end of the body portion 352 of the pin 350. Referring to FIG. 3, the cover 500 has a hole 550 formed through its outer portion 506 to receive the body portion 352 of the pin 350. Referring to FIG. 1, the cover 500 also has a hole 551 formed through its inner portion 504 to receive the body portion 352. At least one of the holes 550, 551 is sized to receive the body portion 352 of the pin 350 in a friction fit designed to retain the body portion 352 in the holes 550, 551 until the head formation 354 is grasped and the pin 350 pulled out of the holes 550, 551 as depicted in FIGS. 3, 7 and 8.

Figure 9:
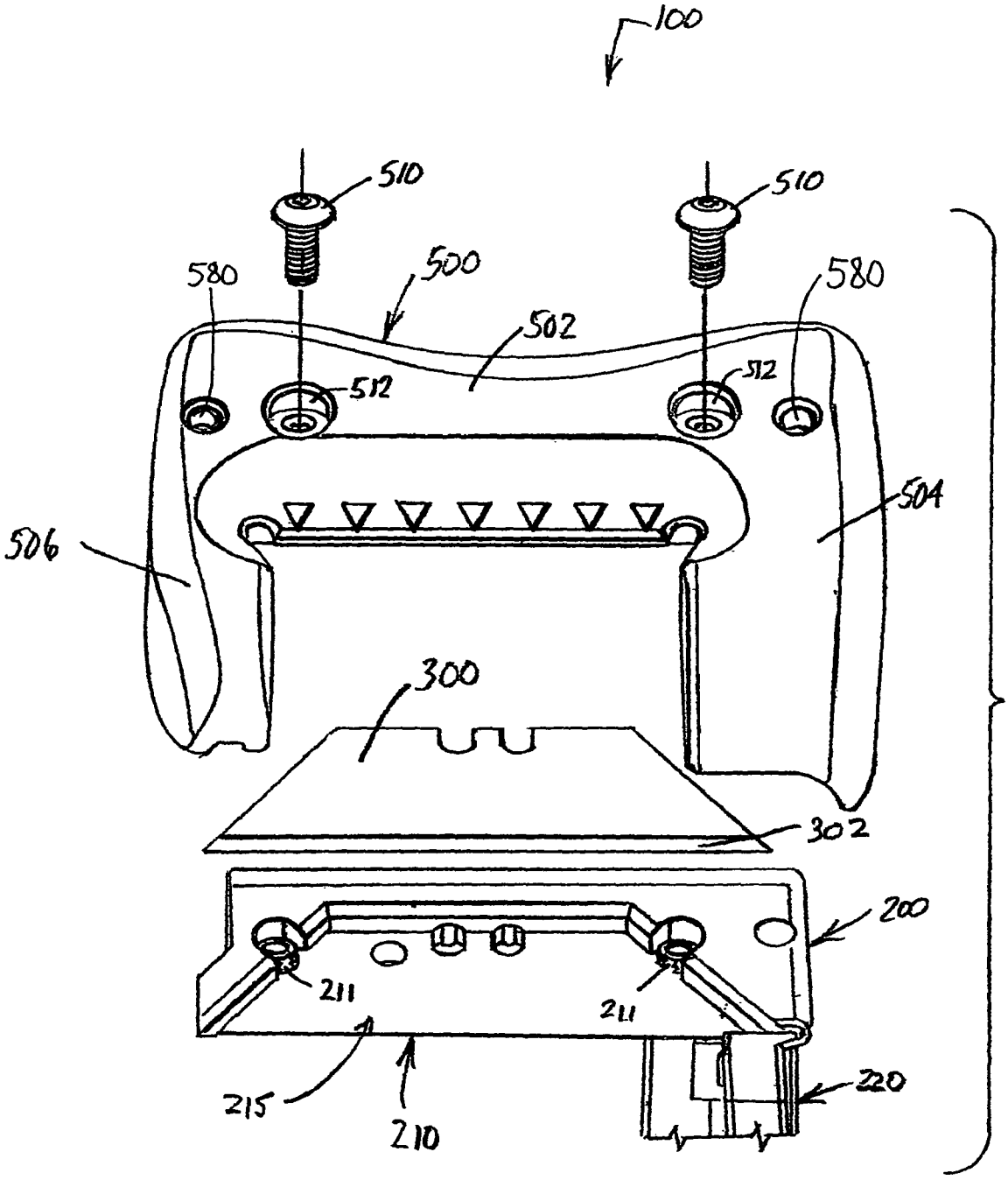
Figure 10:
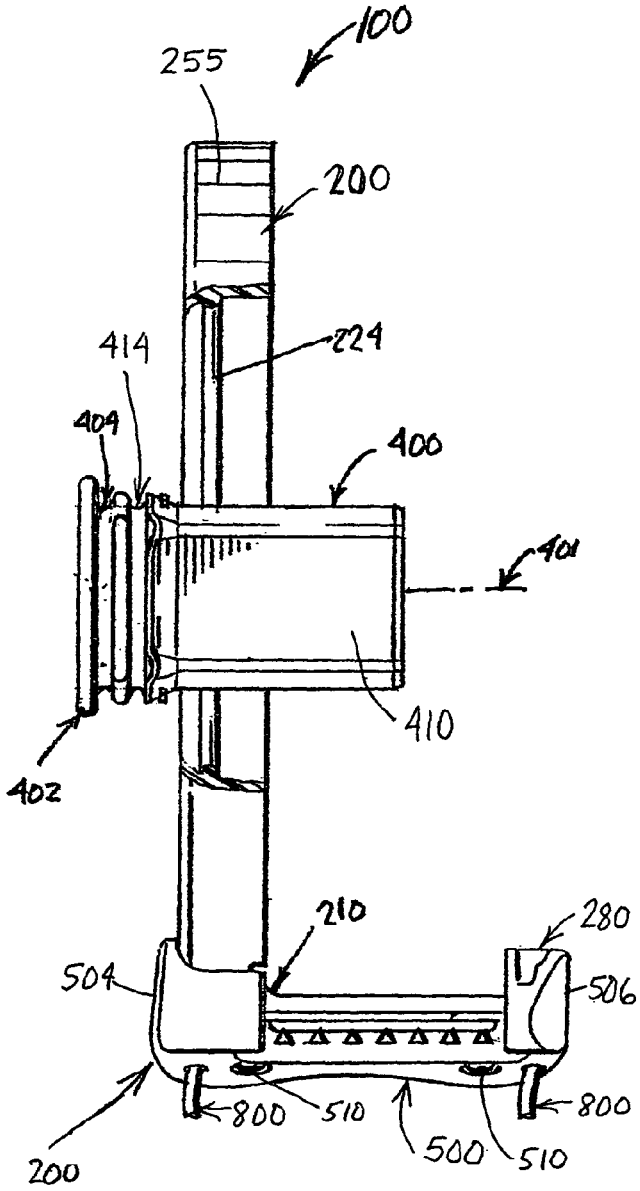
FIG. 10 is a front elevational view showing the spindle of the tape dispenser of FIGS. 1-9 partially inserted through the relatively wide slot that extends along the long leg of the body, with a portion of the long leg of the body broken away.
Figure 11:
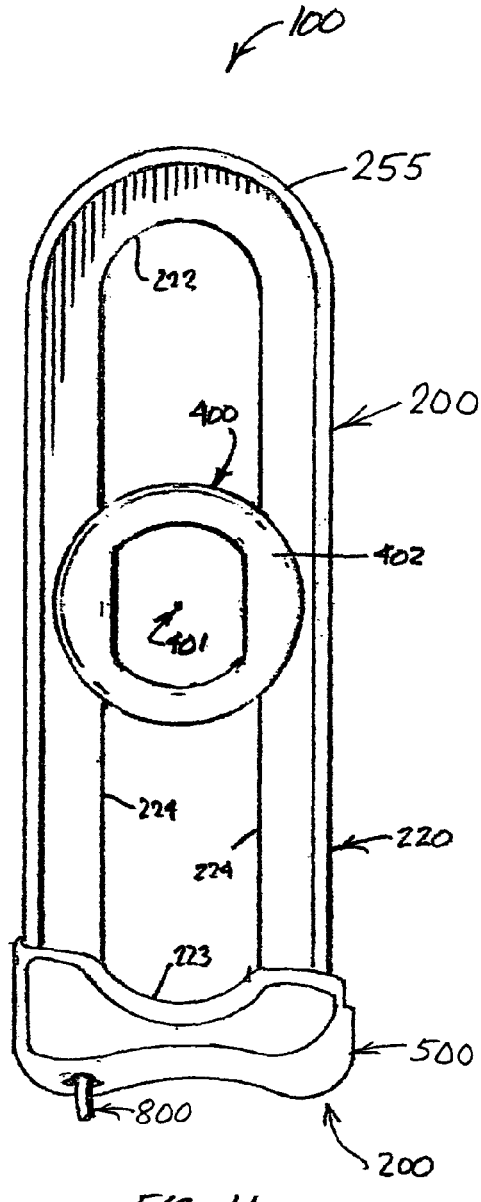
FIG. 11 is an inner side view thereof.
Figure 12:
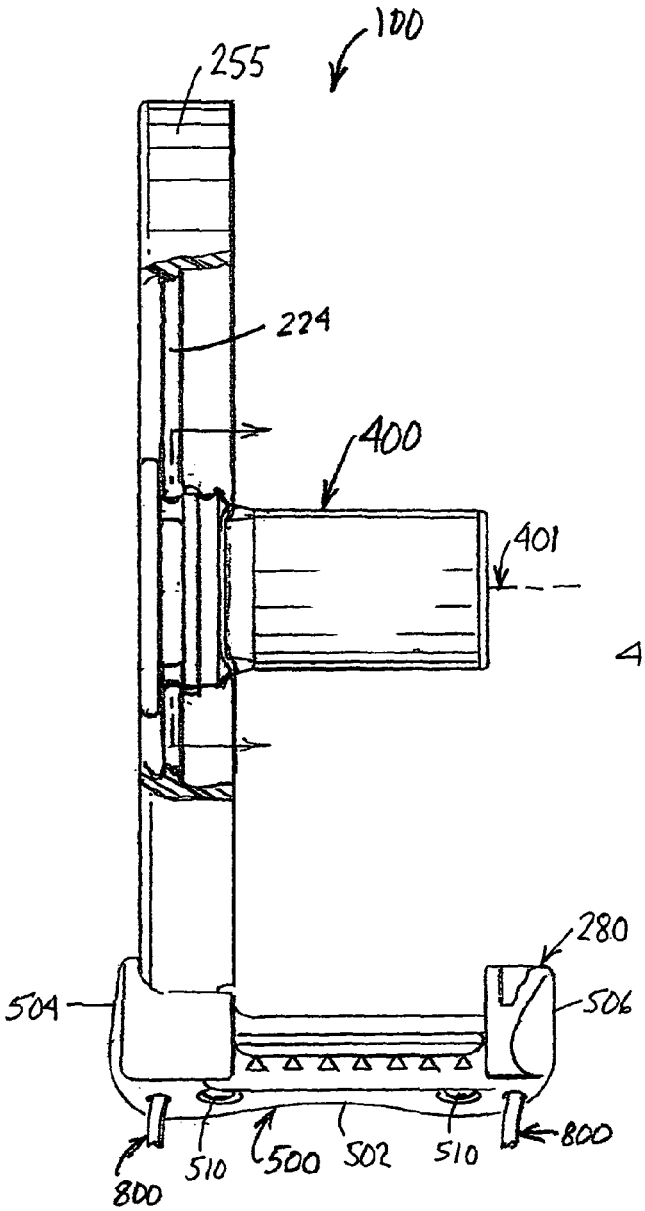
FIG. 12 is a front elevational view showing the spindle more completely inserted into the slot of the long leg.

As is best seen in FIGS. 4, 7 and 9, a pair of holes 580 may be formed through the cover 500 to receive portions of a flexible band 800 that may carry a belt connector 810 thereon to allow the tape dispenser 100 to be clipped to a belt or strap or garment of a user to position the dispenser 100 for ease of use.

As the foregoing description and the accompanying drawings illustrate, the dispenser 100 is formed from a relatively small number of simply formed components that can be assembled with ease, with the spindle 400 being pushed through and snapped into place so that the portions 224 of the long leg 220 that extend along opposite sides of the slot 222 are received in the first outwardly facing groove 402. Once the spindle 400 has been pushed into the slot 222 and snapped into engagement with the portions 224, the spindle 400 can be turned approximately a quarter turn to bring the flat surfaces 424 located on opposite sides of bottom regions of the first groove 402, into a position where the flat surfaces 424 extend along the parallel-extending portions 224 to establish a sliding connection between the spindle 400 and the body 200.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

What is claimed is:

1. A rolled tape dispenser comprising:

a) a body having a relatively primary leg configured to extend along one of two opposite sides of a roll of tape to be dispensed, and a shorter secondary leg configured to support a cutting blade that extend at least partially transversely across a generally cylindrical outer surface of the roll of tape, said primary leg includes a slot formed therethrough;

b) a spindle extending at least through said slot in said primary leg of said body, at least a portion of said spindle configured to extend into a hollow central core of the roll of tape to support the roll of tape on said spindle, said spindle including a connection arrangement designed to secure said spindle in said slot of said primary leg and to enable said spindle to move at least partially along a length of said slot, said spindle including an enlarged head formation, said connection between said spindle and said primary leg at least partially established by inserting at least a portion of said enlarged head through said slot of said primary leg sufficiently far to introduce parallel extending portions of said primary leg that at least partially form said slot so that the parallel extending portions engage groove arrangements of said spindle to provide a sliding connection that permits said spindle to move along a length of said slot without rotating within said slot; and, c) a spindle biasing arrangement connected to said body and said spindle, said spindle biasing arrangement designed to bias said spindle in toward said secondary leg so that when the roll of tape is supported on said spindle a generally cylindrical outer surface of the roll of tape is biased toward said cutting blade.

2. The rolled tape dispenser as defined in claim 1, wherein said spindle biasing arrangement includes a stretchable band that is at least partially wrapped around a portion of said spindle.

3. The rolled tape dispenser as defined in claim 2, wherein said primary leg portion includes a shield formation configured to protectively overlie at least a portion of said stretchable band to at least partially shield said stretchable band from inadvertent user contact.

4. The rolled tape dispenser as defined in claim 2, wherein said spindle includes groove that defines a location wherein said stretchable band at least partially wraps around said spindle.

5. The rolled tape dispenser as defined in claim 3, wherein said spindle includes a groove that defines a location wherein said stretchable band at least partially wraps around said spindle.

6. The rolled tape dispenser as defined in claim 5, wherein said primary leg is longer than said secondary leg, said primary and secondary leg forming a generally L-shaped body.

7. The rolled tape dispenser as defined in claim 6, wherein said cutting blade is formed from a thin, substantially flat piece of metal and has a sharpened edge, said flat piece of metal inclined at an angle relative to the generally cylindrical outer surface of the roll of tape when the roll of tape is biased to toward said cutting blade.

8. The rolled tape dispenser as defined in claim 7, wherein said angle of inclination does not change as the tape is depleted from the roll of tape.

9. The rolled tape dispenser as defined in claim 8, wherein said primary leg has a length greater than a radius of the roll of tape mounted on said spindle.

10. The rolled tape dispenser as defined in claim 9, including a guard member connected to said body and extending at least partially over said cutting blade to guard at least one sharpened edge of said cutting blade against inadvertent user contact.

11. The rolled tape dispenser as defined in claim 10, wherein said guard member is at least partially formed a flexible material to enable a user to at least partially cause said guard member to deflect when cutting tape on said cutting blade.

12. The rolled tape dispenser as defined in claim 11, wherein said secondary leg portion underlies a portion of said cutting blade and a cover that overlies at least a portion of said cutting blade and at least one fastener that secures said cover to said secondary portion such that a portion of said cutting blade is sandwiched between said cover and said secondary portion.

13. The rolled tape dispenser as defined in claim 12, wherein said fastener is disengagable to accommodate replacement of said cutting blade.

14. The rolled tape dispenser as defined in claim 1, wherein said primary leg is longer than said secondary leg, said primary and secondary leg forming a generally L-shaped body.

15. The rolled tape dispenser as defined in claim 1, wherein cutting blade is formed from a thin, substantially flat piece of metal and has a sharpened edge, said flat piece of metal inclined at a fixed angle relative to the generally cylindrical outer surface of the roll of tape when the roll of tape is biased to toward said cutting blade.

16. The rolled tape dispenser as defined in claim 15, wherein said angle of inclination does not change as the tape is depleted from the roll of tape.

17. The rolled tape dispenser as defined in claim 16, wherein said angle of inclination is about forty to about fifty degrees.

18. The rolled tape dispenser as defined in claim 1, wherein said primary leg has a length greater than a radius of the roll of tape mounted on said spindle.

19. The rolled tape dispenser as defined in claim 1, including a guard member connected to said body and extending at least partially over said cutting blade to guard at least one sharpened edge of said cutting blade against inadvertent user contact.

20. The rolled tape dispenser as defined in claim 19, wherein said guard member is at least partially formed a flexible material to enable a user to at least partially cause said guard member to deflect when cutting tape on said cutting blade.

21. The rolled tape dispenser as defined in claim 1, wherein said secondary leg portion underlies a portion of said cutting blade and a cover that overlies at least a portion of said cutting blade and at least one fastener that secures said cover to said secondary portion such that a portion of said cutting blade is sandwiched between said cover and said secondary portion.

* * * * *